US006119636A

United States Patent [19]

Fan

[11] Patent Number: 6,119,636

[45] Date of Patent: Sep. 19, 2000

[54] PORTABLE GENERATOR

[76] Inventor: Guo Xiang Fan, 1021 Long View Dr., Diamond Bar, Calif. 91265

[21] Appl. No.: 09/330,455

[22] Filed: Jun. 11, 1999

[51] Int. Cl.[7] ..... F02B 63/04

[52] U.S. Cl. ..... 123/2; 290/1 A; 290/1 B; 310/62

[58] Field of Search ..... 123/2, 179.28, 123/179.29; 322/1; 290/1 B, 1 A; 310/62

[56] References Cited

U.S. PATENT DOCUMENTS

| | | | |
|---|---|---|---|
| 4,475,075 | 10/1984 | Munn | 322/1 |
| 4,677,940 | 7/1987 | Bracjt et al. | 123/2 |
| 4,721,070 | 1/1988 | Tanaka et al. | 123/2 |
| 4,874,959 | 10/1989 | Sheridan | 290/1 B |

*Primary Examiner*—Andrew M. Dolinar

*Assistant Examiner*—Katrina B. Harris

*Attorney, Agent, or Firm*—Raymond Y. Chan; David and Raymond

[57] ABSTRACT

A portable gasoline generator, constructed with an engine and a generator, provides a lightweight and compact size for easy storage and carrying by minimizing its weight and size of the alternator (generator) thereof. The generator includes a generator case which houses a stator and a rotor unit that is coaxially coupled with a driving end of the crankshaft. The rotor unit includes a rotor cap and a plurality of arc-shaped rotor magnets made of rare-earth metal circularly attached to an inner circumferential surface of a surrounding ring of the rotor cap. The rotor cap is constructed to function as an exhausting fan by puncturing a plurality of fan wings aligned radially and forming a plurality of fan vents thereon. The stator is coaxially affixed to a generator cup of the generator case, wherein the stator is coaxially positioned within the rotor cap that the rotor magnets are arranged to coaxially surround the stator.

3 Claims, 5 Drawing Sheets

PORTABLE GENERATOR

BACKGROUND OF THE PRESENT INVENTION

1. Field of Invention

The present invention relates to generators, and more particularly to a high efficiency portable generator having a lightweight and compact size for easy storage and carrying.

2. Description of Related Arts

Various kinds of well known portable generator are developed such as U.S. Pat. Nos. 4,595,841, 5,093,611, 4,647,835, 5,555,853, and etc. Conventional portable generator comprises an engine and an alternator (or generator) directly connected to and driven by the engine to generate electricity.

The spark-ignited combustion engine produces mechanical power to drive a crankshaft to rotate. The crankshaft is connected with a revolving shaft of the generator which can induce electrical current by transforming the mechanical power produced from the engine into electrical energy due to the relative movement between a magnetic field and electrically conductive elements.

However, the aforesaid conventional portable generators are not practically portable because of their heavy weight and large size. They claim portable simply because they have incorporated a carrying means. Such as, U.S. Pat. No. 5,555,853 provides a back-pack for carrying the engine/alternator unit; U.S. Pat. No. 4,647,835 provides a box casing with handle for carrying the portable generator. In fact, the conventional portable generator is difficult to be transported in a car trunk and is hard to be carried by a female or a junior with one hand. Generally, more than half of the weight of the conventional portable generator is the alternator; more than half of the size of the conventional portable generator is the alternator too.

In order to produce undirectional cooling air for cooling the engine and the alternator, cooling fans are installed to cool the engine and the alternator respectively. U.S. Pat. No. 4,647,835 suggests how to incorporate a single cooling fan at the connection portion of a crankshaft in the engine and a revolving shaft in the alternator (generator). The cooling fan(s) not only increases the size of the portable generator, but also increase the weight of the portable generator.

Moreover, the conventional structure of the alternator/generator is also relatively complicated. A revolving shaft, supported by bearings, is extended through the alternator from the crankshaft either to connect and drive the rotor with permanent magnets to coaxially rotate within the stator inductor, or to connect and drive the rotor with permanent magnets around the stator inductor. However, these elongated shaft, supporting bearings, and shells unnecessarily increase the weight and size of the conventional portable generator.

SUMMARY OF THE PRESENT INVENTION

It is a main object of the present invention to provide a portable generator having a lightweight and compact size for easy storage and carrying, wherein the weight and size of the alternator (generator) thereof is minimized by constructing with minimum components to perform high efficiency.

It is an additional object of the present invention to provide the portable generator, wherein the conventional cooling fan(s) are further eliminated to reduce the size and weight thereof while the cooling function and effect are still maintained in the present invention.

It is another object of the present invention to provide a portable generator, wherein rare-earth metal made magnets are incorporated in the alternator (generator) to achieve higher efficiency of transforming the mechanical power to electrical energy.

It is another object of the present invention to provide a portable generator, wherein the recoil starter is more efficiently connected with the crankshaft, so as to save starting power and effort and achieve a more balance structure and weight for the whole portable fuel generator.

In order to accomplish the above objects, the present invention provides a portable generator comprising an engine for producing mechanical power, and a generator directly connected to and driven by the engine for inducing electrical current by transforming the mechanical power produced from the engine into electrical energy.

The engine comprises a spark-ignited internal combustion engine including a spark plug and a crankshaft rotatable by the engine; an engine fuel reservoir for containing a fuel such as gasoline; a carburetor for mixing air with the fuel and having an outlet connected to the spark ignited internal combustion engine and an inlet coupled to the engine fuel reservoir; and a starter means which is connected to a driven end of the crankshaft for starting the engine.

The generator, which can be an alternator, comprises a generator case which houses a stator and a rotor unit that is coaxially coupled with a driving end of the crankshaft. The generator case merely comprises a supporting wall mounted to the engine and a generator cup coaxially attached on the supporting wall so as to define a generator chamber between the generator cup and the supporting wall. The supporting wall provides a plurality of vents and a central hole enabling the driving end of the crankshaft to extend therethrough into the generator chamber for coupling with the rotor unit. The rotor unit comprises a rotor cap having a circular base disc and a surrounding ring integrally and coaxially extended from a peripheral edge of the base disc. A plurality of arc-shaped rotor magnets made of rare-earth metal are circularly attached to an inner circumferential surface of the surrounding ring of the rotor cap. The base disc is constructed to function as an exhausting fan by puncturing a plurality of fan wings aligned radially and forming a plurality of fan vents thereon.

The generator cup has a cup wall and a circumferential wall extended from the cup wall to form a U-shaped cross section. A plurality of air vents is provided around the generator cup. The stator is coaxially affixed on the cup wall of the generator cup. When the generator cup is affixed on the supporting wall, the stator is coaxially positioned within the rotor cap that the rotor magnets are arranged to coaxially surround the stator. Thereby, when the crankshaft rotates, the driving end of the rotating crankshaft drives the rotor cap to rotate inside the generator chamber. The rotor magnets is then rotating around the stator to induce electrical current, so that the mechanical rotation motion of the crankshaft of the engine is transformed into electrical energy due to the relative movement between a magnetic field of the rotor magnets and electrically conductive elements of the stator. When the base disc of the rotor unit is driven to rotate by the crankshaft, cool air outside the generator will be sucked into the generator chamber through the air vents on the generator cup to cool down the temperature inside the generator. Moreover, the hot air inside the generator chamber will be exhausted outside the generator through the vents provided on the supporting wall.

DETAILED DESCRIPTION OF THE PREFERRED EMBODIMENT

Referring to FIGS. 1 to 4 of the drawings, a portable fuel generator according to a preferred embodiment of the present invention is illustrated. The portable generator comprises an engine 10 for producing mechanical power, and a generator 50 directly connected to and driven by the engine 10 for inducing electrical current by transforming the mechanical power produced from the engine into electrical energy.

Figure 1:
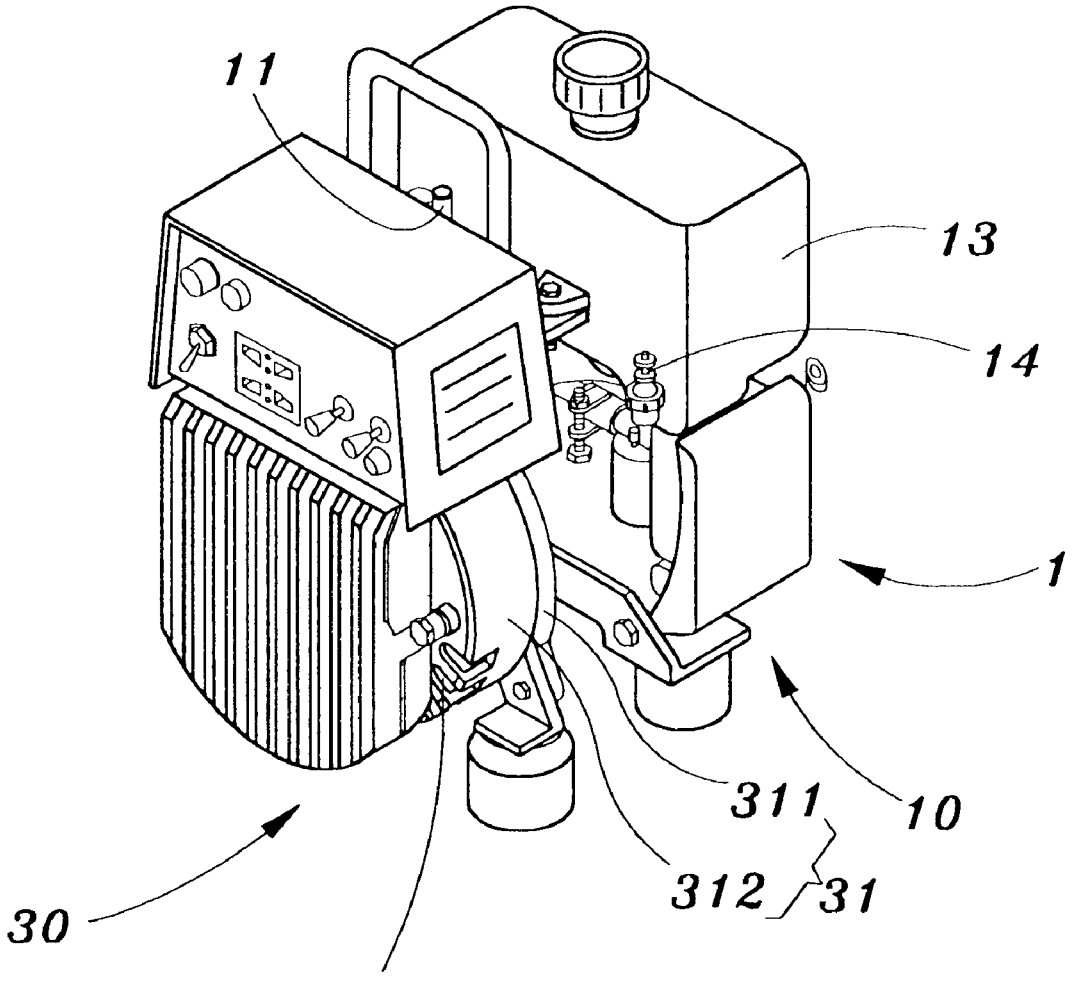
FIG. 1 is an exploded perspective of a portable generator according to a preferred embodiment of the present invention.
Figure 2:
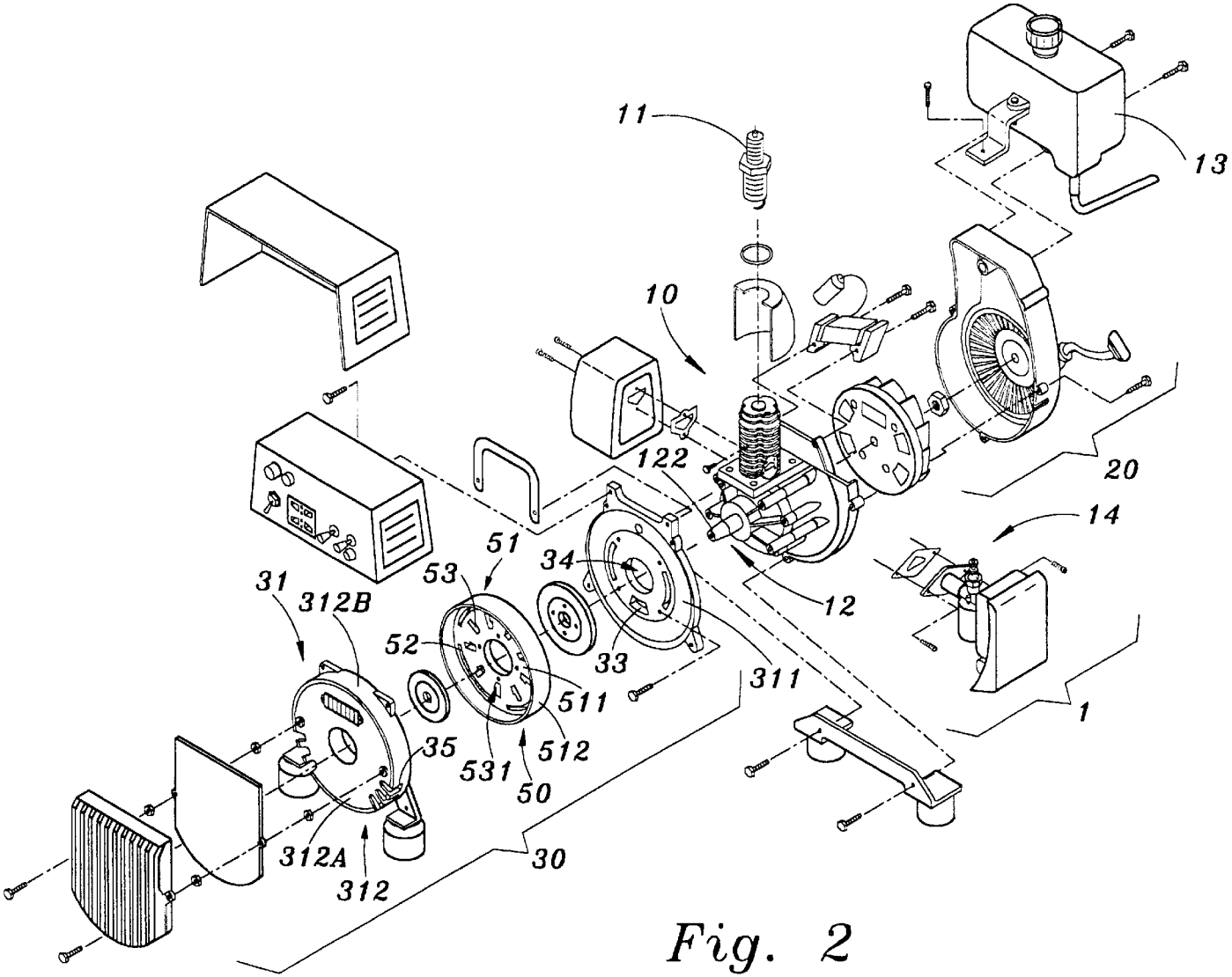
FIG. 2 is an exploded perspective view of the portable generator according to the above preferred embodiment of the present invention.
Figure 3:
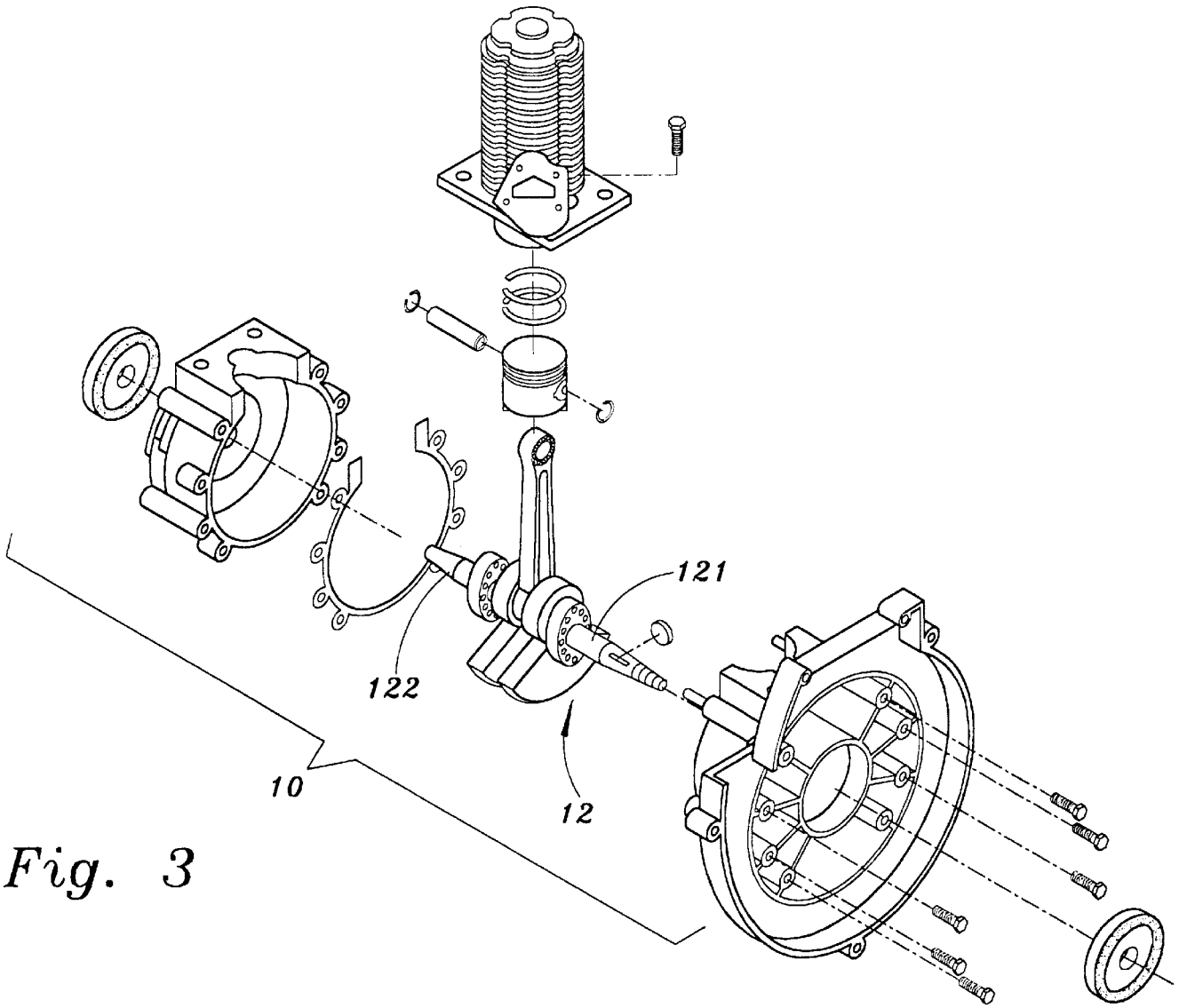
FIG. 3 is an exploded perspective view of the engine of the portable generator according to the above preferred embodiment of the present invention.

The engine 1 comprises a spark-ignited internal combustion engine 10 including a spark plug 11 and a crankshaft 12 rotatable by the engine 10; an engine fuel reservoir 13 for containing a fuel such as gasoline; a carburetor 14 for mixing air with the fuel and having an outlet connected to the spark ignited internal combustion engine 10 and an inlet coupled to the engine fuel reservoir 13; and a starter means 20 which is connected to a driven end 121 of the crankshaft 12 for starting the engine 1 (as shown in FIGS. 2 and 3).

Figure 4:
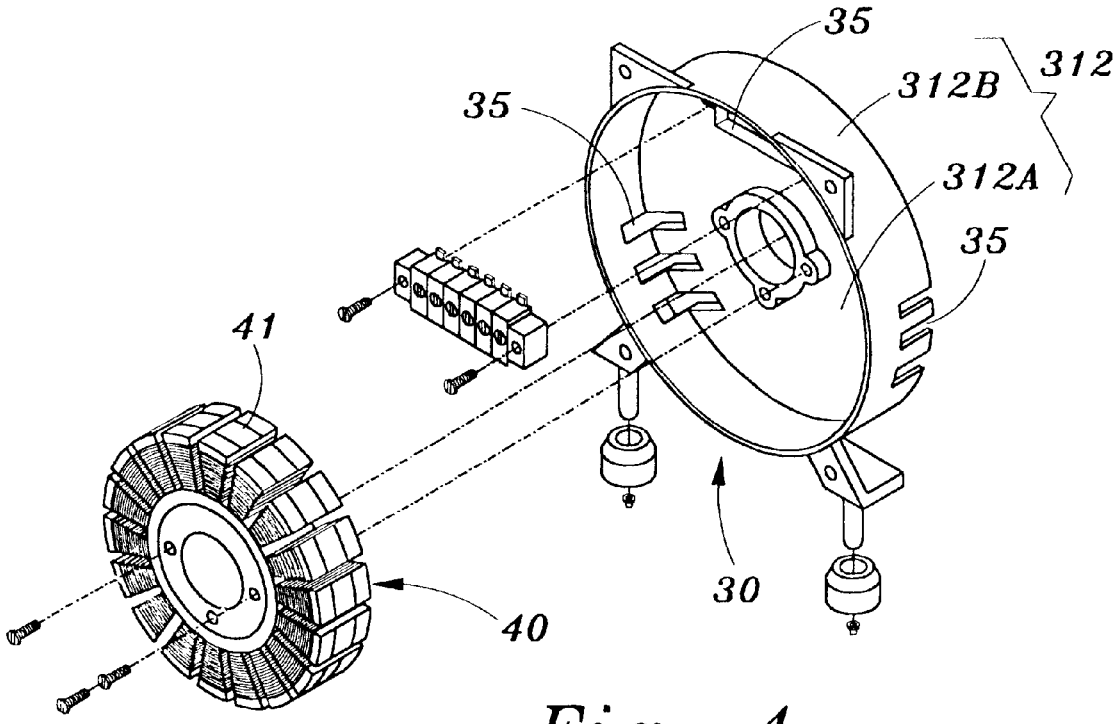
FIG. 4 is an exploded perspective view of the generator cup and the stator of the generator of the portable generator according to the above preferred embodiment of the present invention.
Figure 5:
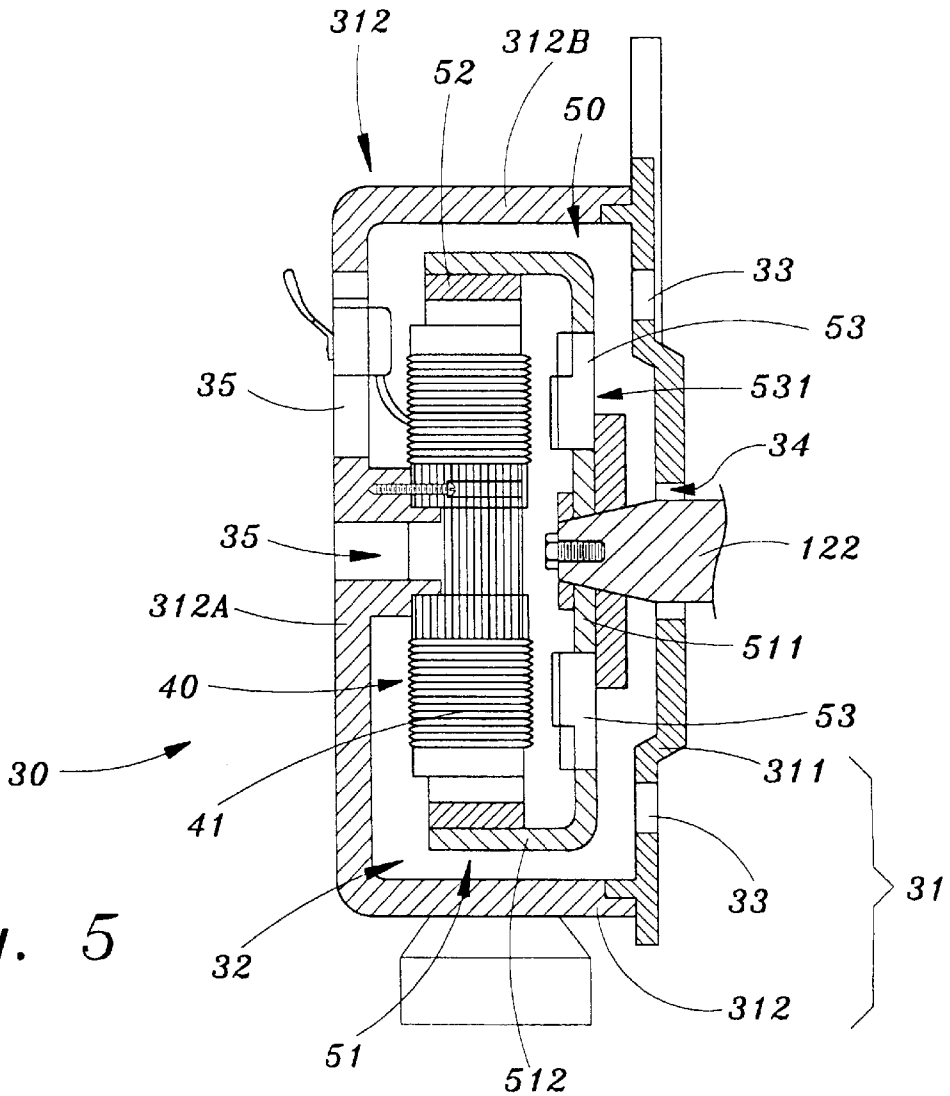
FIG. 5 is a sectional view of the generator of the portable generator according to the above preferred embodiment of the present invention.

The generator 30, which can be an alternator as shown in FIGS. 2, 4 and 5, comprises a generator case 31 which houses a stator 40 and a rotor unit 50 that is coaxially coupled with a driving end 122 of the crankshaft 12. The generator case 31 merely comprises a supporting wall 311 mounted to the engine 1 and a generator cup 312 coaxially attached on the supporting wall 311 so as to define a generator chamber 32 between the generator cup 312 and the supporting wall 311. The supporting wall 311 provides a plurality of vents 33 and a central hole 34 enabling the driving end 122 of the crankshaft 12 to extend therethrough into the generator chamber 32 for coupling with the rotor unit 50.

The rotor unit 50 comprises a rotor cap 51 having a circular base disc 511 and a surrounding ring 512 integrally and coaxially extended from a peripheral edge of the base disc 511. A plurality of arc-shaped rotor magnets 52 made of rare-earth metal are circularly attached to an inner circumferential surface of the surrounding ring 512 of the rotor cap 51. The base disc 511 is constructed to function as an exhausting fan by puncturing a plurality of fan wings 53 aligned radially and forming a plurality of fan vents 531 thereon.

The generator cup 312 has a cup wall 312A and a periphery wall 312B extended from the cup wall 312A to form a U-shaped cross section. A plurality of air vents 35 are provided around the generator cup 312.

The stator 40 is coaxially affixed on the cup wall 312A of the generator cup 312. When the generator cup 312 is affixed on the supporting wall 311, the stator 40 is coaxially positioned within the rotor cap 51 that the rotor magnets 52 are arranged to coaxially surround the stator 40. Thereby, when the crankshaft 12 rotates, the driving end 122 of the rotating crankshaft 12 drives the rotor unit 50 to rotate inside the generator chamber 32. The rotor magnets 52 is then rotating around the stator 40 to induce electrical current, so that the mechanical rotation motion of the crankshaft of the engine is transformed into electrical energy due to the relative movement between a magnetic field of the rotor magnets 52 and electrically conductive elements 41 of the stator 40.

When the base disc 511 of the rotor cap 511 of the rotor unit 50 is driven to rotate by the crankshaft 12, cool air outside the generator 30 will be sucked into the generator chamber 32 through the air vents 35 on the generator cup 312 to cool down the temperature in side the generator 30. Moreover, the hot air inside the generator chamber 32 will be exhausted outside the generator 30 through the vents 33 provided on the supporting wall 311.

Therefore, according to the present invention, the base disc 511 of the rotor cap 51 also acts and works as an exhausting fan for ventilating outside air to cool generator 30. In other words, an independently conventional generator cooling fan can be omitted to reduce the weight and size of the portable generator of the present invention.

Moreover, the length of the driving end 122 of the crankshaft 12 is minimized by directly coupled with the rotor unit 50 which is specifically designed as a U-shaped cap, so as to enable the rare-earth metal made rotor magnets to surround and rotate around the stator which is directly affixed to the cup wall 312A of the generator cap 312 coaxially, so that unnecessarily components are all eliminated in order to further reduce the size and weight of the generator 30. Accordingly, the overall size and weight of the portable generator of the present invention.

What is claimed is:

1. A portable generator, comprising:

an engine for producing mechanical power, comprising a spark-ignited internal combustion engine including a spark plug and a crankshaft rotatable by said engine;

an engine fuel reservoir for containing a fuel;

a carburetor for mixing air with said fuel and having an outlet connected to said spark ignited internal combustion engine and an inlet coupled to said engine fuel reservoir; and a starter means which is connected to a driven end of said crankshaft for starting said engine; and a generator directly connected to and driven by said engine for inducing electrical current by transforming said mechanical power produced from said engine into electrical energy, said generator comprising:

a generator case comprises a supporting wall mounted to said engine and a generator cup coaxially attached on said supporting wall so as to define a generator chamber between said generator cup and said supporting wall, said supporting wall having a central hole enabling a driving end of said crankshaft to extend therethrough into said generator chamber; said generator cup having a cup wall and a circumferential wall extended from said cup wall to form a U-shaped cross section;

a rotor unit which is housed in said generator chamber of said generator case and coaxially coupled with a driving end of said crankshaft, said rotor unit comprising a rotor cap having a circular base disc and a surrounding ring integrally and coaxially extended from a peripheral edge of said base disc, and a plurality of arc-shaped rotor magnets made of rare-earth metal being circularly attached to an inner circumferential surface of said surrounding ring of said rotor cap; and a stator which is coaxially affixed on said cup wall of said generator cup, wherein said stator is coaxially positioned within said rotor cap that said rotor magnets are arranged to coaxially surround said stator in such a manner that when said crankshaft rotates, said driving end of said rotating crankshaft drives said rotor cap to rotate inside said generator chamber, and that said rotor magnets is then rotating around said stator to induce electrical current, so that said mechanical rotation motion of said crankshaft of said engine is transformed into electrical energy due to said relative movement between a magnetic field of said rotor magnets and electrically conductive elements of said stator.

2. A portable generator, as recited in claim 1, wherein said supporting wall provides a plurality of vents and a plurality of air vents are provided around said generator cup for ventilation.

3. A portable generator, as recited in claim 2, wherein said base disc is constructed to function as an exhausting fan by puncturing a plurality of fan wings aligned radially and forming a plurality of fan vents thereon, thereby when said base disc sucked into said generator chamber through said air vents on said generator cup to cool down said temperature inside said generator and said hot air inside said generator chamber is exhausted outside said generator through said vents provided on said supporting wall.

* * * * *